US005484363A

United States Patent [19]

Creelman et al.

[11] Patent Number: 5,484,363

[45] Date of Patent: Jan. 16, 1996

[54] MOGUL SKIING SIMULATING DEVICE

[76] Inventors: Kevin Creelman, 104 Center St., Ste. 100, Kodiak, Ak. 99615; Terry G. Jacobs, NE. 18911 N. Shore Rd., Tahuya, Wash. 98588

[21] Appl. No.: 280,114

[22] Filed: Jul. 25, 1994

Related U.S. Application Data

[63] Continuation-in-part of Ser. No. 21,138, Feb. 23, 1993, Pat. No. 5,342,265.

[51] Int. Cl.[6] ..... A63B 69/18

[52] U.S. Cl. ..... 482/71; 482/80

[58] Field of Search ..... 601/29, 31, 32, 601/33, 34, 35, 36; 482/79, 80, 51, 71, 52

[56] References Cited

U.S. PATENT DOCUMENTS

| | | | |
|---|---|---|---|
| 3,461,857 | 8/1969 | Poulin | 482/71 |
| 3,501,142 | 3/1970 | Johansson . | |
| 3,831,935 | 8/1974 | Höfle . | |
| 4,074,903 | 2/1978 | Diez de Aux | 482/71 |
| 4,519,603 | 5/1985 | DeCloux . | |
| 4,542,898 | 9/1985 | Grushkin . | |
| 4,641,833 | 2/1987 | Trethewey . | |
| 4,676,501 | 6/1987 | Hoagland et al. | 482/52 |
| 4,708,338 | 11/1987 | Potts . | |
| 4,783,069 | 11/1988 | Cottee | 482/71 |
| 4,842,269 | 6/1989 | Huang . | |
| 4,934,688 | 6/1990 | Lo . | |
| 5,299,993 | 4/1994 | Habing | 482/52 |

FOREIGN PATENT DOCUMENTS

| | | |
|---|---|---|
| 1289516A | 8/1985 | U.S.S.R. . |
| 1443900A | 5/1987 | U.S.S.R. . |

*Primary Examiner*—Lynne A. Reichard
*Attorney, Agent, or Firm*—Richard C. Litman

[57] ABSTRACT

An exercise apparatus especially suitable for simulating mogul skiing conditions. The apparatus may comprise a base which supports a rotatable component which, in turn, supports a platform for supporting a user. The rotational component includes a unidirectional element limiting the direction of rotation of the rotational component to a single direction. A biasing assembly assists and resists the movement of the rotational component and varies the speed of the rotational component in response to a displacement of the rotational component. An alternative exercise apparatus includes a pair of spaced rotational components driven by a prime mover via a power transmitting element. A platform is operatively connected to the pair of rotational components via a platform support assembly. One rotational element leads the other rotational element so as to vary the angular disposition of the platform throughout the rotation of the rotational elements. The prime mover is preferably a variable speed motor. It is also preferable that a switch be provided to interrupt the operation of the prime mover in the event the user inadvertently falls from the platform. Either embodiment may include amenities, such as poles and bindings to further enhance simulated skiing conditions.

19 Claims, 8 Drawing Sheets

A

40
D
83
60
82
86
80
58
84
48
180
52
B
112
110
94
190
38
100
54
C 94
94
180

E
180
184
182
E
190
194
86
186
192
196
38

MOGUL SKIING SIMULATING DEVICE

This is a continuation-in-part of application Ser. No. 08/021,138, filed on Feb. 23, 1993 now U.S. Pat. No. 5,342,265.

BACKGROUND OF THE INVENTION

1. FIELD OF THE INVENTION

The present invention relates generally to an exercise apparatus. The apparatus is especially suitable in simulating the energy expenditure and absorption which muscle groups experience in alpine mogul skiing.

2. DESCRIPTION OF THE PRIOR ART

Exercising devices for conditioning muscle groups are well known. Typically, exercise devices include elemental components dimensioned and configured to interact together to encourage a particular movement of one or more muscle groups. Some devices simulate certain conditions, such as those one encounters when cycling, skiing, and climbing stairs. One such device is shown in U.S. Pat. No. 3,501,142, issued Mar. 17, 1970 to Bengt I. Johansson, disclosing an exerciser with cyclically varying resistance.

U.S. Pat. No. 3,831,935, issued Aug. 27, 1974 to Hubert Höfle, discloses a movable platform exercising device having two double crank arms attached to a frame. The double crank arms revolve about a horizontal axle. The inner arms of the double crank are connected to at least one movable platform upon the frame. Handle bars are pivotally attached to the outer arms of the double cranks. In operation, a user stands on the platform grasping the handle bars. By shifting his or her weight, the platform is caused to move in a circular motion. As the platform rises, the handle bars lower and vice versa. The motion of the platform is opposed by a plurality of springs which tend to maintain the platform in a horizontal attitude.

U.S. Pat. No. 4,519,603, issued May 28, 1985 to Richard J. DeCloux, discloses an exercise device including pedals and cranks, a braking mechanism, and controls for operating the braking mechanism.

U.S. Pat. No. 4,708,338, issued Nov. 24, 1987 to Lanny L. Potts, discloses a stair climbing exercise apparatus including a frame having a base and a plate joined perpendicularly to the base. Right and left pedals adapted to support the feet of a user are disposed on opposite sides of the plate. A drive system assembly is associated with the plate. The drive system assembly includes right and left pedal sprockets and a drive sprocket. The right and left pedal sprockets are independently oscillatable between an upper and lower position. A continuous chain drivingly engages a transmission input and the drive sprocket. A continuous belt drivingly engages a transmission output and an alternator.

Soviet Union Inventor's Certificate No. SU 1289-526-A, issued Aug. 28, 1985, discloses a foot muscle exercise apparatus having a frame attached to a seat. The frame contains platforms for supporting the user's feet. The platforms are joined to the frame by a plurality of springs disposed at desperate angles.

Soviet Union Inventor's Certificate No. SU 1443-900-A, issued May 12, 1987, discloses a leg joint exerciser including a plurality of articulated rods having means for respectively attaching the rods to the thigh, the lower leg, and the foot of the user. A first rod is attachable to the user's thigh. The first rod is further pivotally connected to a frame and linked to a drive shaft via a first connecting rod and crank.

A second connecting rod pivotally connects the first connecting rod to a second rod. The second rod is attachable to the user's lower leg. A third connecting rod pivotally connects the second connecting rod to the rear end of a rod attached to the user's foot.

None of the above inventions and patents, taken either singly or in combination, is seen to describe the instant invention as claimed.

SUMMARY OF THE INVENTION

The present invention relates to an exercise apparatus especially suitable for simulating skiing conditions. The apparatus comprises a base which supports a rotatable crank assembly. A platform for supporting the feet of a user rotatably engages the crank assembly. This engagement is accomplished by means of a unidirectional bearing which enables the platform to rotate only in a reverse direction. A biasing assembly operatively couples the crank assembly to the base by way of a chain carried by an offset sprocket. The offset sprocket is attached to an offset shaft associated with the crank assembly. The biasing assembly applies a reciprocating rotational force upon the crank assembly that assists and resists the rotation of the platform. The cooperative relationship between the biasing assembly and the crank assembly varies the speed of the rotation of the sprocket and, in turn, the crank assembly with respect to the position of the crank assembly. To this end, the rotational force applied and the leverage required to induce the motion of the platform varies in accordance with the relative position of the platform.

An alternative exercise apparatus includes a pair of spaced rotational components driven by a prime mover via a power transmitting element. A platform is operatively connected to the pair of rotational components via a platform support assembly. One rotational component leads the other rotational component so as to vary the angular disposition of the platform throughout the rotation of the rotational components. The prime mover is preferably a variable speed motor. It is preferable that a switch be provided to interrupt the operation of the prime mover in the event the user inadvertently falls from the platform.

Either embodiment may include amenities, such as poles and bindings to further enhance simulated skiing conditions.

Accordingly, it is a principal object of the invention to provide an exercise apparatus having a rotational component especially suitable for simulating skiing conditions.

It is another object to incorporate an unidirectional element which restricts the movement of the rotational component.

It is a further object that the rotational component apply a reciprocating rotational force that both assists and resists the user in displacing the rotational component.

Still another object is vary the speed of rotational movement of the rotational component with respect to the displacement of the rotational component.

It is another object to provide an alternative, power driven exercise apparatus including a pair of rotational components operatively linked to one another and a platform supported by the pair of rotational components.

It is yet another object that the angular disposition of the platform vary in accordance with the rotational displacement of the pair of rotational components.

Another object is that the power driven exercise apparatus be a variable speed apparatus and that apparatus include safety elements for interrupting the operation of the apparatus.

Another object is to provide amenities to further improve simulated skiing conditions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
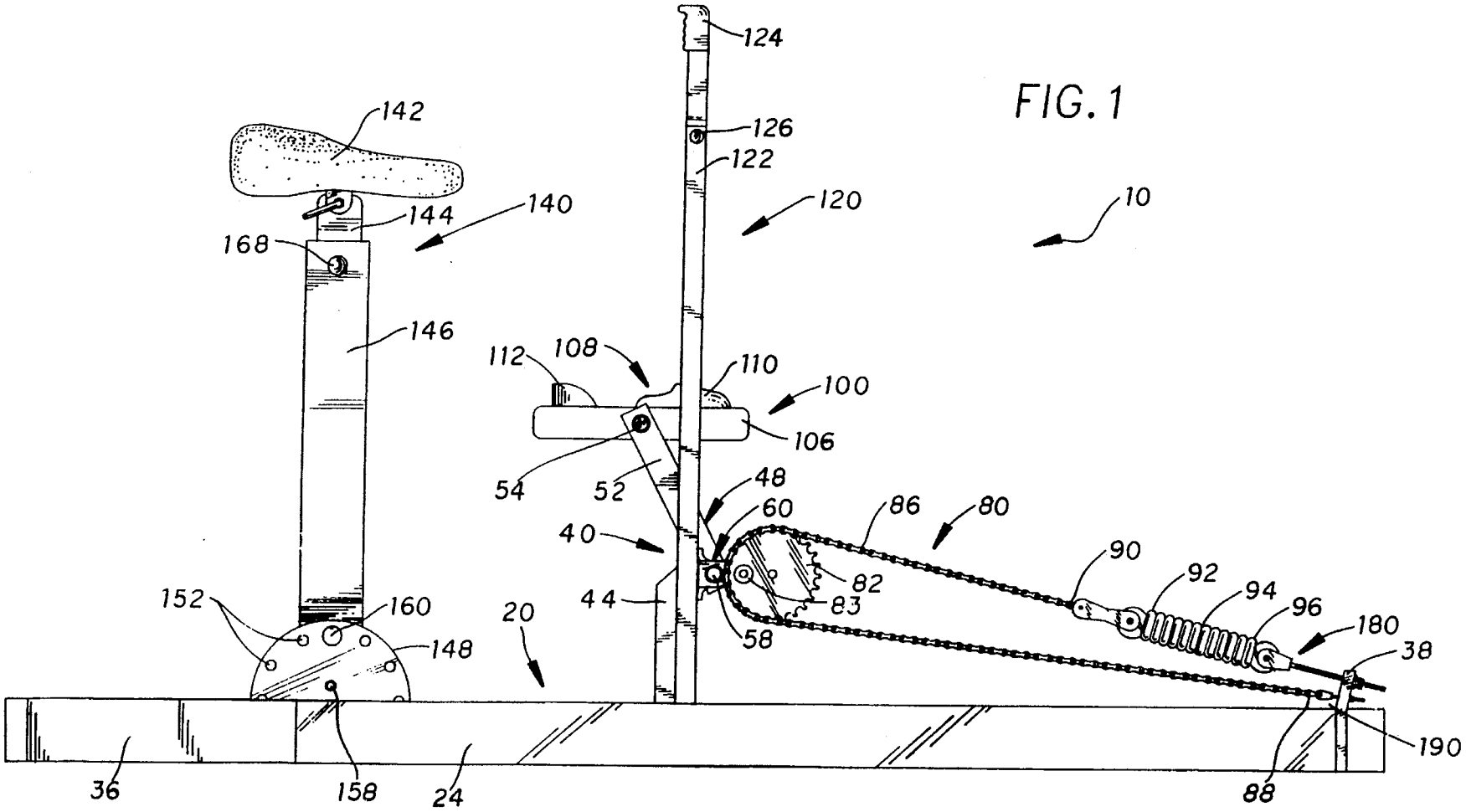
FIG. 1 is a side elevation view of an exercise apparatus in accordance with the present invention.
Figure 2:
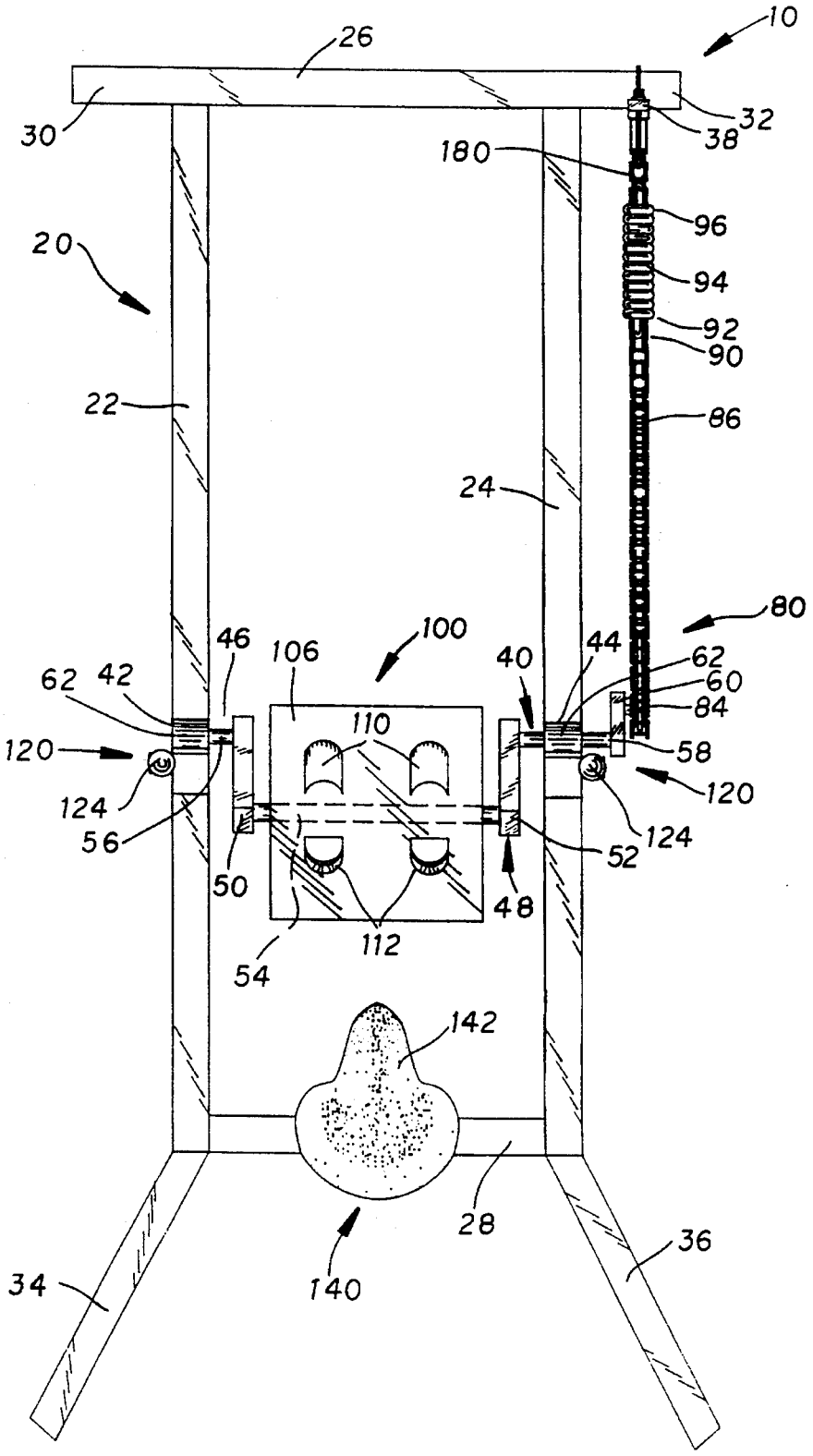
FIG. 2 is a top plan of the exercise apparatus shown in FIG. 1.

The present invention, as shown in FIGS. 1 and 2, is an exercise apparatus 10. The apparatus 10 is particularly useful simulating mogul skiing conditions and in the training and conditioning of the muscle groups that a skier uses when skiing moguls. The apparatus 10 simulates energy expenditure and absorption that muscle groups encounter when mogul skiing. The apparatus 10 includes a base 20, a crank assembly 40, a biasing assembly 80, a platform 100, and poles 120.

The base 20 comprises spaced left and right longitudinal rods 22, 24 positioned substantially parallel with one another. The left and right longitudinal rods 22, 24 are connected by spaced front and rear laterally extending rods 26, 28 also positioned substantially parallel with one another. The orientation of these rods 22, 24, 26, 28 forms a substantially rectangular frame structure.

The front laterally extending rod 26 has joined thereto left and right extension segments 30, 32 which respectively extend perpendicularly beyond the left and right longitudinal rods 22, 24. The left and right extension segments 30, 32 cooperatively provide supplemental stability about the longitudinal axis of the base 20. Joined traversely to the rear laterally extending rod 28 are spaced left and right angularly disposed extensions 34, 36. These extensions 34, 36 provide supplemental support and stability in both the longitudinal and lateral directions of the base 20.

The base 20 may be assembled through conventional welding methods or via a threaded fastener arrangement (neither of which are shown). It should be noted that the dimensions of the base 20 must be suitable to sustain a user (not shown) in an upright orientation during the operation of the apparatus 10.

The crank assembly 40, biasing assembly 80, and handles 100 are all supported by the base 20. The crank assembly 40 is rotatably joined to the base 20. The base 20 is comprised of left and right vertical support elements 42, 44. A first crank, referred to as a left crank 46, and a second crank, referred to as a right crank 48, are rotatably joined to the left and right support elements 42, 44, respectively.

The left crank 46 is laterally spaced apart from, and axially aligned with, the right crank 48. Each crank 46, 48 is provided with an inner arm 50, 52. Each inner arm 50, 52 is disposed in a plane positioned substantially parallel to the left and right longitudinal rods 22, 24. The inner arms 50, 52 are oppositely disposed in a coplanar arrangement with respect to one another and are joined together by a laterally disposed connecting rod 54. The connecting rod 54 is fixedly attached to the inner arms 46, 48 so as to maintain the coplanar orientation of the inner arms 50, 52. This attachment may be accomplished through a conventional welding method, a press fit, or through matingly engageable male and female threaded elements (none of which are shown).

Extending outwardly and substantially perpendicularly from each inner arm 50, 52 is a bearing support element 56, 58. The bearing support elements 56, 58, respectively, carry first and second unidirectional bearings 62. The unidirectional bearings 62 are of the conventional type, such as roller clutch bearings, (e.g., part number RCB121616, manufactured by Torrington Fafner of Torrington, Conn.). The unidirectional bearings 62 join the crank assembly 40 to the base 20 and are permitted to roll in a single direction and thus, limit the rotation of the crank assembly 40 to a single direction, preferably a reverse bicycle pedaling motion. The unidirectional bearings 62 permit each crank 46, 48 to be rotatably supported by its respective vertical support element 42, 44.

As shown in the drawings and more particularly, in FIG. 2, the right crank 48 is inclusive of an outer arm 60. The inner and outer arms 52, 60 of the right crank 48 are disposed in planes substantially parallel relative to one another and extend in opposing directions from their juncture. The inner and outer arms 52, 60 have adjacent ends joined together by a bearing support element 58 so as to produce the serpentine or S-shaped configuration shown. It should be clear to one skilled in the art that either or both cranks 46, 48 may include an outer arm for the purposes intended as will be made apparent through the description of the biasing assembly 80 disclosed hereinafter.

The biasing assembly 80 is operatively coupled to the crank assembly 40 and the base 20. A rotational force is produced by the biasing assembly 80 and applied to the crank assembly 40. The rotational force is variable in accordance with a relative position of the crank assembly 40.

The biasing assembly 80 includes a sprocket 82 for applying the rotational force to the crank assembly 40. The sprocket 82 has an offset hub 83 rotatably engaging an offset shaft 84. The offset shaft 84 projects outwardly and substantially perpendicularly from the outer arm 60 of the right crank 48 so as to orbit about the axis of rotation of the left and right cranks 46, 48. The sprocket 82 may be movably mounted to the shaft 84 in some well known conventional manner.

A bearing or a bushing (not shown) may be carried between the shaft 84 and the offset hub 83 of the sprocket 82 to reduce wear and friction between the shaft 82 and the offset hub 83. This, in turn, reduces maintenance requirements of the shaft 82 and the offset hub 83.

The sprocket 82 is meshingly engaged by a first segment of a chain 86. The chain 90 delivers the rotational force to the sprocket 82. The chain 86 has a distal end 88 and a proximal end 90. The distal end 88 of the chain 86 is joined to an anchor 38 located at a forward end of the base 20. A proximal end 90 of the chain 86, or a second segment thereof, is connected to the anchor 38 via a tension spring 94. A proximal end 92 of a tension spring 94 is connected to the proximal end 90 of the chain 86 and a distal end 96 of the tension spring 94 is joined to the anchor 38 in the same vicinity as the distal end 88 of the chain 86.

Figure 8A:
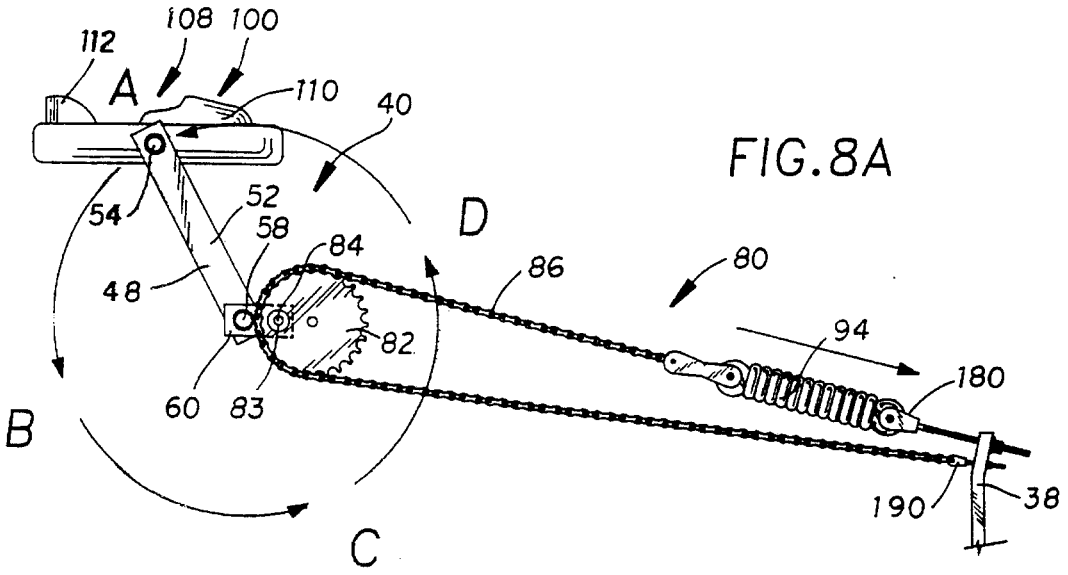
FIGS. 8A and 8B are diagrammatic representations showing variations in displacement of the biasing assembly relative to the rotational position of the platform.
Figure 8B:
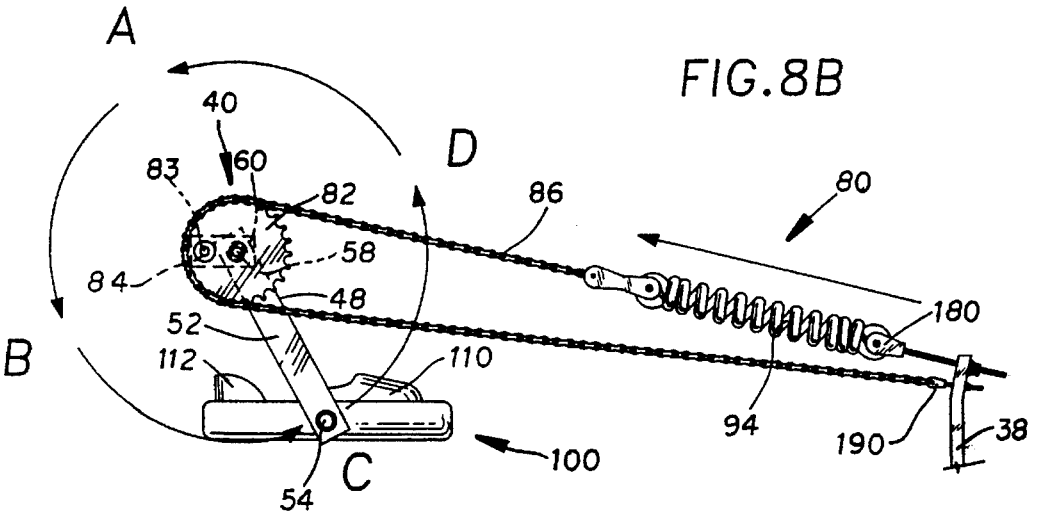

The spring 94 produces the rotational force which is applied to the crank assembly 40. As the crank assembly 40 rotates about its axis of rotation, as shown in FIGS. 8A and 8B, the offset sprocket 82 orbits around the same axis of rotation, in turn, movably carrying the chain 86 and oscillating the tension spring 94 between a state of relaxation and flexion.

As will be disclosed hereinafter, the oscillation of the tension spring 94 assists and resists the rotation of the crank assembly 40 depending on the relative position of the same. Preferably, the respective ends 96, 88 of the spring 94 and the chain 86 each have attached thereto separate turn buckles 180, 190 (see also FIG. 9). The turn buckles 180, 190 engage the base 20 and permit the user to adjust the rotational force applied to the sprocket 82 and, in turn, applied to the crank assembly 40.

Figure 3:
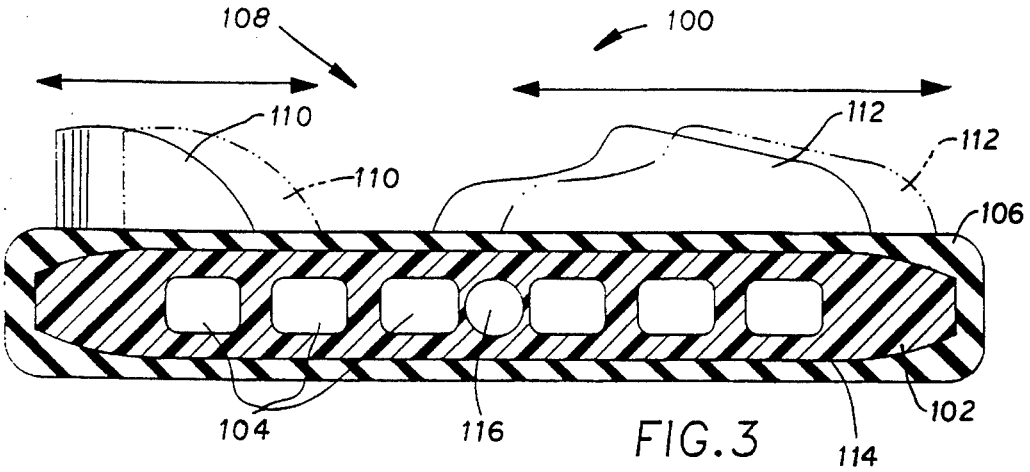
FIG. 3 is a cross sectional view of a platform.

Referring now to FIGS. 1, 2 and 3, the laterally extending connecting rod 54 joining the left and right cranks 46, 48 passes through a passage 72 in the platform 100 so as to rotatably engage the platform 100 and the crank assembly 40. The platform 100 is rotatable so as to be permitted to maintain a constant relative attitude, such as the horizontal attitude shown in FIG. 1, as the laterally extending connecting rod 54 and platform 100 alike orbit about the axis of rotation of the crank assembly 40.

The platform 100 supports a user and may assume various attitudes, such as an inclined posture (not shown) which is more suitable if the user chooses to sit on the seat 142.

The platform 100 is comprised of a rigid core 102 having an aperture therein to permit the passage of the laterally extending connecting rod 54 therethrough. The rigid core 102 is capable of sustaining the weight of the user. Preferably, the rigid core 102 is fabricated of a fiberglass material so as to reduce manufacturing cost. To further reduce manufacturing costs, a reduction in fiberglass material may be achieved by providing hollow areas 104 in the rigid core 102. It should be noted that other materials, such as aluminum, would produce a like effect.

To reduce the risk of harm to the user, a padding material 106, such as the rubber padding shown in the drawings, is preferably joined to the outer surface 114 of the platform 100. If the user were to become inadvertently removed from the platform 100 through the motion of the crank assembly 40, the padding 106 would protect the user against direct impact with the rigid core 102.

To further reduce the risk of injury to the user, left and right boots or bindings 108, each comprising a heel and toe portion 110, 112, are positioned atop the platform 100 to receive and retain a respective foot (not shown) of the user. Preferably, the heel and toe portions 110, 122 are movably attached to the platform 100, such as through some conventional slidably adjustable arrangement (not shown). The heel portions 110 and/or the toe portions 112 may be adjusted in the longitudinal direction so as to further ensure the retention of the feet of the user. The bindings 108 are preferably produced from a resilient material which provides comfort and snugly conforms snugly to the shape of the user's feet.

Focusing again on FIG. 1, the left and right posts 120 are provided for a user to grasp. Each post 120 includes a standard 122 and a handgrips 124. The standards 122 are rigidly secured to and extend upwardly from the base 20. Specifically, the left and right posts 120 are connected, respectively, to the left and right elongated rods 22, 24 in a fashion similar to that in the aforementioned description directed toward the assembly of the base 20, that is, through the use of a conventional welding method or threaded fasteners (not shown). The posts 120 provide stability for the user during the operation of the apparatus 10.

The handgrips 124 may slidably engage an upper end of the standards 122 so as to permit the height of the handgrips 124 to be adjusted or varied in accordance with the size and the posture of the user. The cooperative engagement of each handgrip 124 with its respective standard 122 may be fixed via the slidable engagement of a pin 126 through an aperture 128 in the standard 122 and any one of the array of apertures 130 in the handgrip 124 which axially aligns with the aperture 128 in the standard 122. The pin 126 may be of the conventional type including a recessable, spring biased ball 132 (construction details thereof not provided) located in the tip thereof. The spring biased ball 132 would prevent the pin 126 from being accidentally dislodged from the apertures 128, 130.

Figure 7:
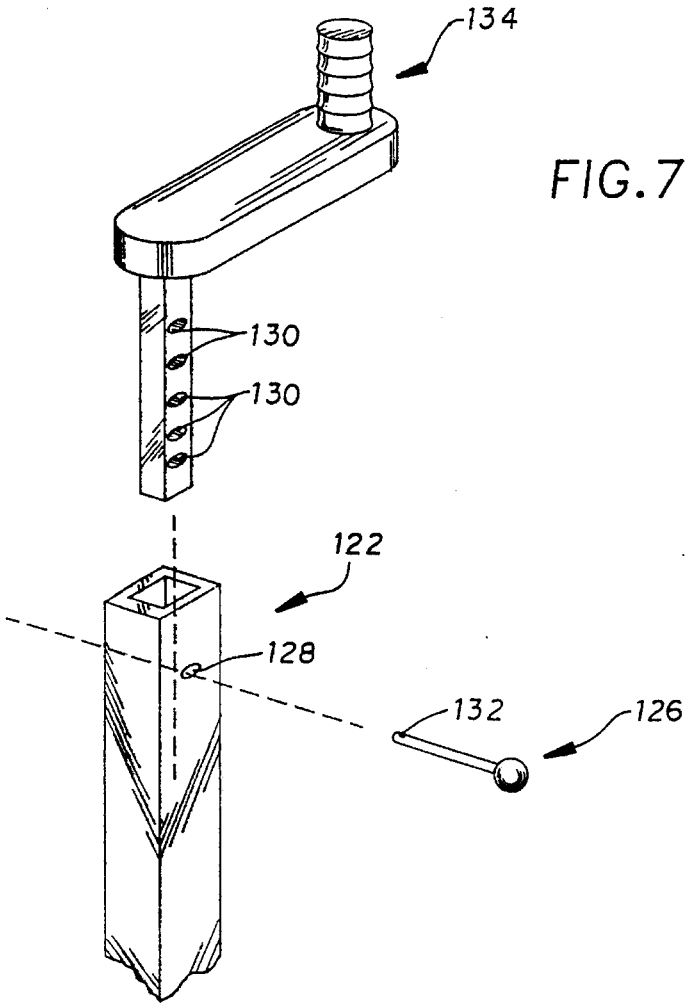
FIG. 7 is a partially exploded, partial front elevational view of an alternative hand grip.

The handgrip 124, as shown in FIG. 1, is preferred when a user assumes a seated posture. However, FIG. 7 shows an alternative handgrip 134 which is more suitable for a user assuming a standing posture. One handgrip 124 may be replaced with the other handgrip 134, for example, by removing the pin 126, removing the undesired handgrip 124 from the standard 122, inserting the desired handgrip 134 into the standard 122, and reinserting the pin 126 through the apertures 128, 130.

Referring now to FIGS. 1 and 2, and FIGS. 4 through 6, showing a removable seat assembly 140 for supporting a user's upper body. The seat assembly 140 is attachable to the base 20. The seat assembly 140 includes a seat 142 attachable to an upper end of a staff 146. The seat 142 and the staff 146 are preferably connected together by a seat post 144. The staff 146 facilitates in supporting the seat 142. The seat 142 is attached to the upper end of the seat post 144 via a pivotally adjustable fastener. The seat post 144 may be slidably engageable with a staff 146 and is adjustable to vary the height of the seat 142.

A lower end of the staff 146 is attachable to the base 20 at the rear lateral extension rod 28. The base 20 has a left and right semi-circular plate 148 spaced apart and affixed to the rear lateral rod 28 proximate its mid point. Each plate 148 includes a centrally disposed hole 150 and a plurality of holes 152 disposed about the periphery of the semi-circular plate 148. Spaced apart openings 154, 156 are provided in the lower end of the staff 146. These openings 154, 156 align correspondingly with the holes 150, 152 in the plates 148.

Figure 4:
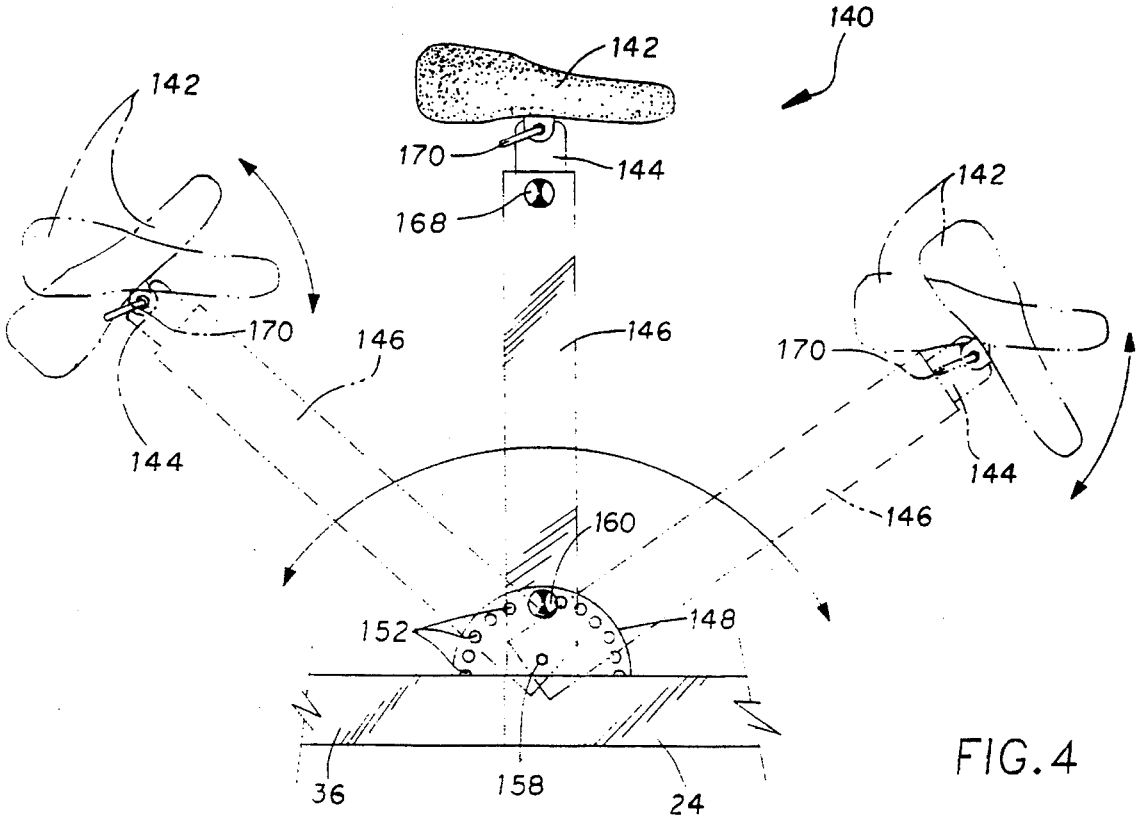
FIG. 4 is a partial side elevational view of the exercise apparatus shown in FIG. 1 showing the pivotal adjustment of the seat assembly in phantom lines.

The staff 146 is pivotally connected between the two plates 148 by a fastener 158, such as the threaded fastener shown, insertable through the centrally disposed hole 150 and the lowermost opening in the staff 154. This pivotal attachment allows the staff 146 to be adjusted radially, as shown in FIG. 4. Once a desired disposition of the staff 148 has been achieved, a pin 160 is insertable through a respective one of the plurality of holes 152 in each of the semi-circular plates 148 as well as through the uppermost opening 156 in the lower end of staff 146 disposed therebetween. The pin 160 maintains the staff 146 in a desired position. Similar to the pin 126 associated with the posts 120, this pin 160 may be provided with a spring biased ball 162 (construction details thereof not provided).

Figure 6:
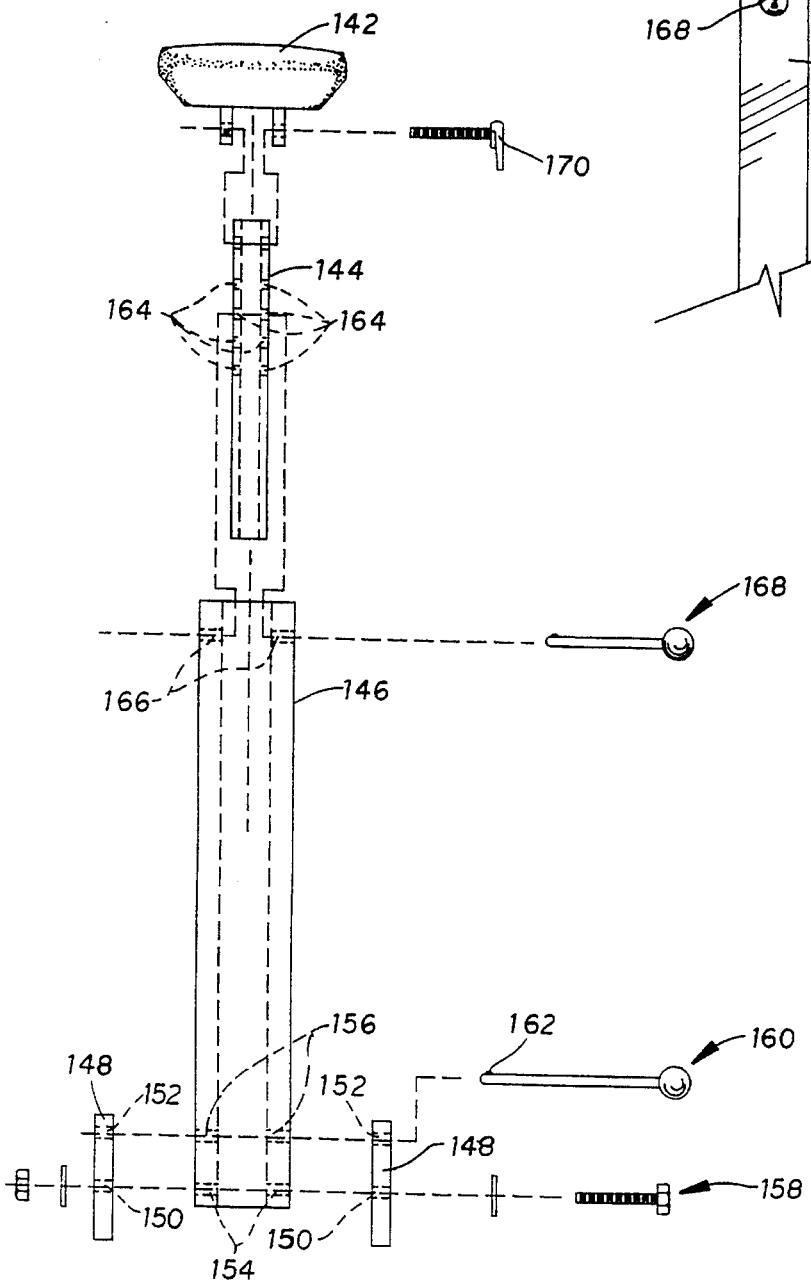
FIG. 6 is a partially exploded, partial rear elevational view of the seat assembly shown in FIG. 4.

To maintain a horizonal displacement of the seat 142 in the various positions of the staff 148, located on the bottom of the seat 142 is the pivotal attachment which is cooperatively and pivotally attached to the seat post 144, such as through the use of a conventional quick release threaded fastener 170, as is shown more clearly in FIG. 6.

Figure 5:
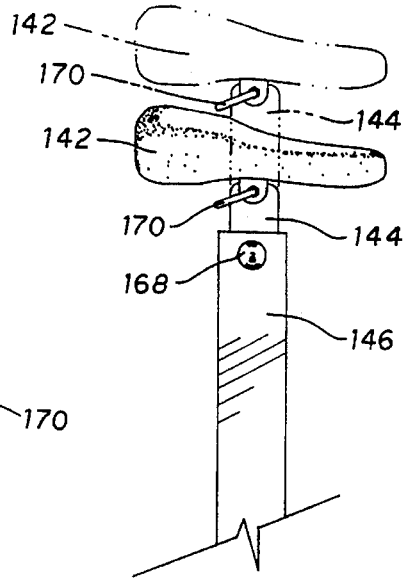
FIG. 5 is a partial side elevational view of the seat assembly shown in FIG. 4 showing the vertical adjustment of the seat assembly in phantom lines.

Moreover, to accommodate users of various sizes, the height of the seat 142 is adjustable, as shown in FIGS. 5 and 6, by way of the telescopic engagement of the seat post 144 and the staff 146. A plurality of holes 164 are provided along the length of the seat post 144 which are selectively alignable with an opening 166 in the staff 146. A pin 168 is engageable with the corresponding hole 164 and opening 166 in a manner similar to that which maintains the handgrips 124, 134 and the radial positioning of the staff 146.

The operation of the apparatus 10 is as follows. The feet of the user are supported by the platform 100 and may be utilized to apply force to displace the crank assembly 40 in a reverse bicycle motion, as shown in FIGS. 8A and 8B, in response to a kick cam action of the crank assembly 40. A kick cam action is an action which accumulates energy throughout one half of the counterclockwise rotation of the crank assembly 40 from point A to point B to point C and delivers energy in an aggressive force throughout the second half of the counterclockwise rotation from point C to point D back to point A to encourage the users legs to bend. The configuration of the crank assembly 40 and the biasing assembly 80, particularly the sprocket 82 configuration, and the interaction of the same distributes the biasing forces throughout the arc of a circle, simulating mogul skiing conditions.

Initially, the platform 100 is at rest at position A, as shown in FIG. 8A. The condition simulated is the mogul top where the legs are bent. The tension spring 94 is relaxed and thus, the forces are diminished. As the platform 100 rotates counterclockwise from point A to point B, the condition simulated is the mogul front. The user's legs begin to extend and a moderate amount of resistance is felt by the user. As the platform 100 continues to rotate counterclockwise and approaches point C from point B, the user's legs fully extend, pushing downward and foreword, counteracting the force of the tension spring 94. As the platform 100 passes the threshold of point C and continues to rotate counterclockwise past point D, returning to point A, the mogul backside condition is simulated. The tension spring 94 aggressively pushes the legs into a bent posture. The kick cam action releases the energy from the tension spring 94 to be absorbed by the user's legs as the legs assume a bent attitude.

In summary, when the crank assembly 40 is rotated by the user, the sprocket 82 is forced to revolve towards the fixed end of the chain 86. The offset hub 83 causes the sprocket 82 to rotate at varying speeds relative to the position of the crank assembly 40. Over the displacement of the crank assembly 40, the leverage applied by the tension spring 94 varies.

Figure 9:
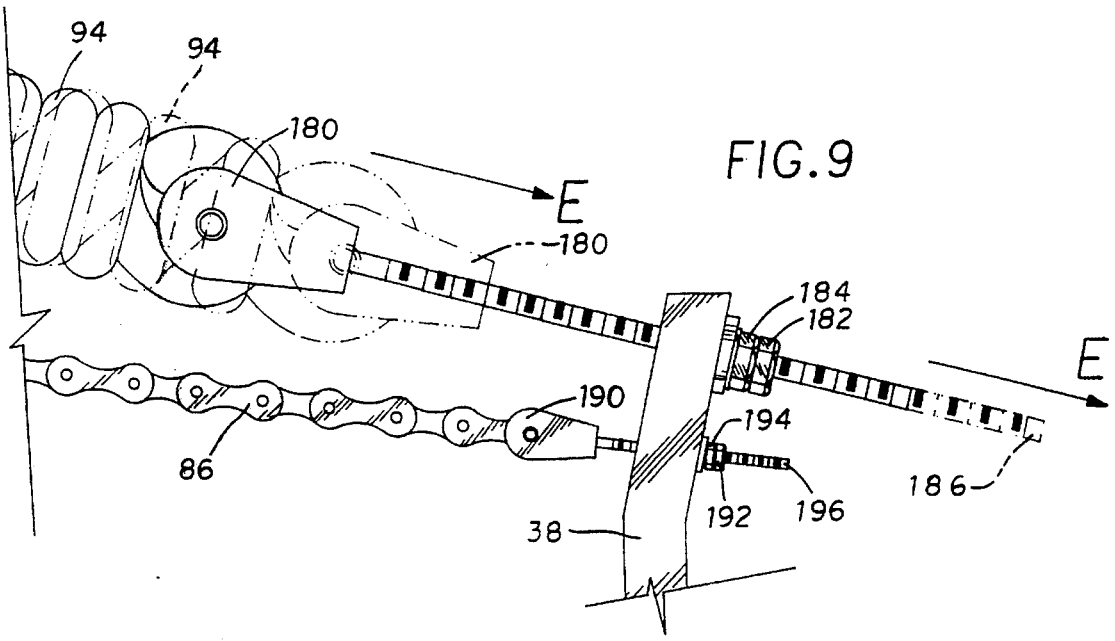
FIG. 9 is a side elevational view of a spring tension adjustment mechanism of the biasing assembly.

Preferably, the tension spring 94, the chain 86, or both are coupled to the anchor 38 by means of separate turnbuckles 180, 190, as is shown, more particularly, in FIG. 9. The energy delivered from the tension spring 94 to the crank assembly 40 is varied by loosening the lock nut 182, 192 free from contact with the tension nut 184, 194 and turning the tension nut 184, 194. For example, the tension can be increased by turning the tension nut 184 clockwise so as draw the threaded shaft 186 in the direction E which, in turn, displaces the turnbuckle 180 in the direction E. To decrease the tension, simply turn the tension nut 184 counterclockwise. Once the desired tension is achieved, the user may merely tighten the lock nut 182 back against tension nut 184.

Figure 10:
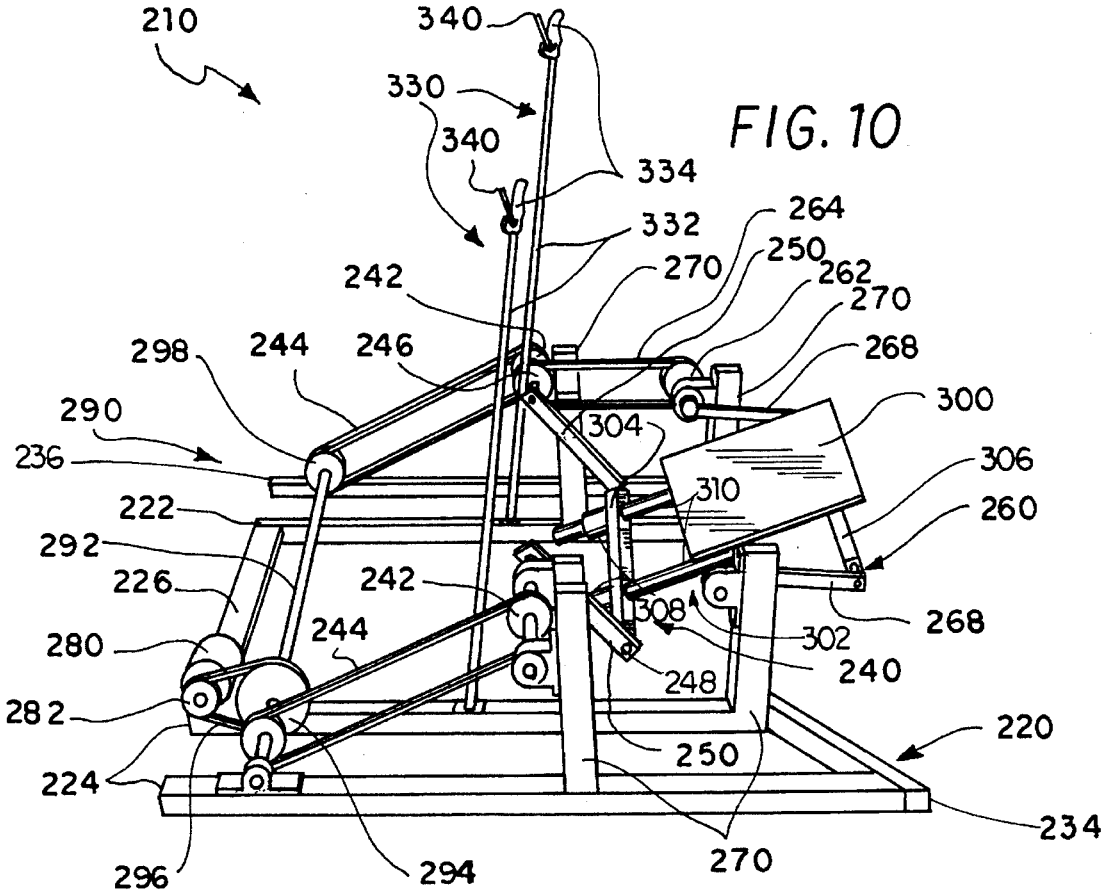
FIG. 10 is a side perspective view of an alternative exercise apparatus.

An alternative exercise apparatus 10, as shown in FIG. 10, is power driven. The exercise apparatus includes a base 220, a pair of crank assemblies 240, 260 supported by the base 220, a prime mover 280 for driving the crank assemblies 240, 260, and a power transmitting element 290 for transmitting power from the prime mover 280 to the crank assemblies 240, 260.

The base 220 includes spaced longitudinal members 222, 224 disposed parallel relative to one another, and at least one lateral member 226 adjoining the longitudinal members 222, 224. Transverse members 234, 236 may be provided for improving the stability of the base 220.

The base 220 supports each of the crank assemblies 240, 260 in a spaced relationship relative to one another. The crank assemblies 240, 260 include a first or leader crank assembly 240 and a second or follower crank assembly 260. The crank assemblies 240, 260 are supported by respective crank supports 270 comprising stanchions. The stanchions are provided with pillow blocks, providing bearing support for the crank assemblies 240, 260.

The crank assemblies 240, 260 are driven via a power transmitting element 290 by a prime mover 280, such as a ½ horse power single phase motor. The prime mover 280 is preferably a variable speed prime mover controllable by an A/C variable controller. The power transmitting element 290 includes an arbor 292 having a driven sprocket 294 attached thereto. The driven sprocket 294 is driven by a drive sprocket 282 carried by the drive shaft of the prime mover 280 via a first chain or cog belt 296.

The arbor 292 further has attached thereto at least one output sprocket 298 for transmitting power to a respective input sprocket 242 carried by the first crank assembly 240. The output sprocket 298 is linked to the input sprocket 242 by a second chain or cog belt 244. The arbor 292 may be provided with a pair of oppositely disposed output sprockets and the first crank assembly may include corresponding input sprockets, as are shown in the drawings.

The first crank assembly 240 further includes at least one output sprocket 246 for delivering power to a respective input sprocket 262 carried by the second crank assembly 260. These sprockets 246, 262 are coupled via a third chain or cog belt 264.

The crank assemblies 240, 260 cooperatively support a platform 300 via a platform support assembly 302. The platform support assembly 302 permits the distance between the crank assemblies 240, 260 to vary as the crank assemblies 240, 260 rotate. This necessitates a platform support assembly 302 which permits the platform 300 to be slidably displaceable relative to at least one of the crank assemblies 240, 260. For example, the platform support assembly 302 may include a first element 304 supported by the first crank assembly 240 and a second element 306 supported by the second crank assembly 260, wherein the platform 300 is substantially fixed relative to the second element 306 and the second element 306 is slidably engageable with the first element 304.

The first element 304 may include at least one sleeve 308 (e.g., a linear bearing) disposed transversely relative to the throw 248 thereof, the throw 248 being rotatably supported by the crank arms 250. The sleeve 308 may be fabricated from ultra high molecular weight polyethylene (UHMWPE).

The second element 306 may include a spanning shaft 310 disposed transversely relative to the throw 266 of the second crank assembly 260, this throw 266 likewise being rotatably supported by the crank arms 268 of the second crank assembly 260. The spanning shaft 310 extends forwardly of the second crank assembly 260 and is spaced parallel relative to the platform 300. The spanning shaft 310 is further axially slidable within the sleeve 308, permitting the first crank assembly 240 to be rotatably displaced independently of the second crank assembly 260 and vice versa.

Figure 11:
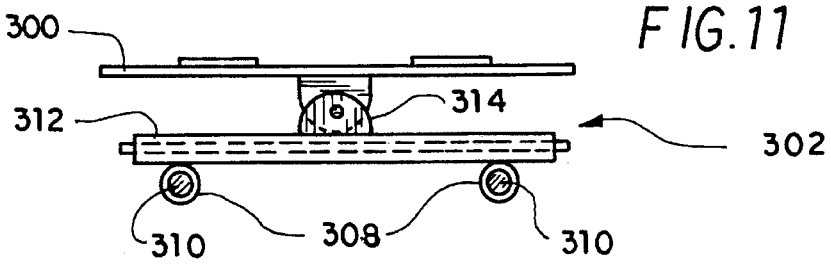
FIG. 11 is a partial sectional view of the platform and platform support assembly of the exercise apparatus shown in FIG. 10.
Figure 12:
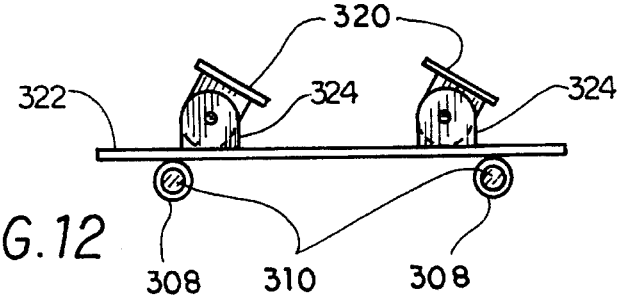
FIG. 12 is a partial sectional view an alternative platform and platform support assembly.

To fix the platform 300 relative to the spanning shaft 310, a mounting bracket 312 is fixedly attached to the spanning shaft 310 and the platform 300, in turn, is affixed to mounting bracket 312. The mounting bracket 312 may either rigidly or loosely support the platform 300. For example, the platform 300 may be attached to the mounting bracket 312 via an universal joint assembly 314, such as that shown in FIG. 11. This improves simulated skiing conditions. To simulate edging, a pair of platforms 320 may be supported by the mounting bracket 322, such as with the universal joint assemblies 324 shown in FIG. 12.

Figure 13:
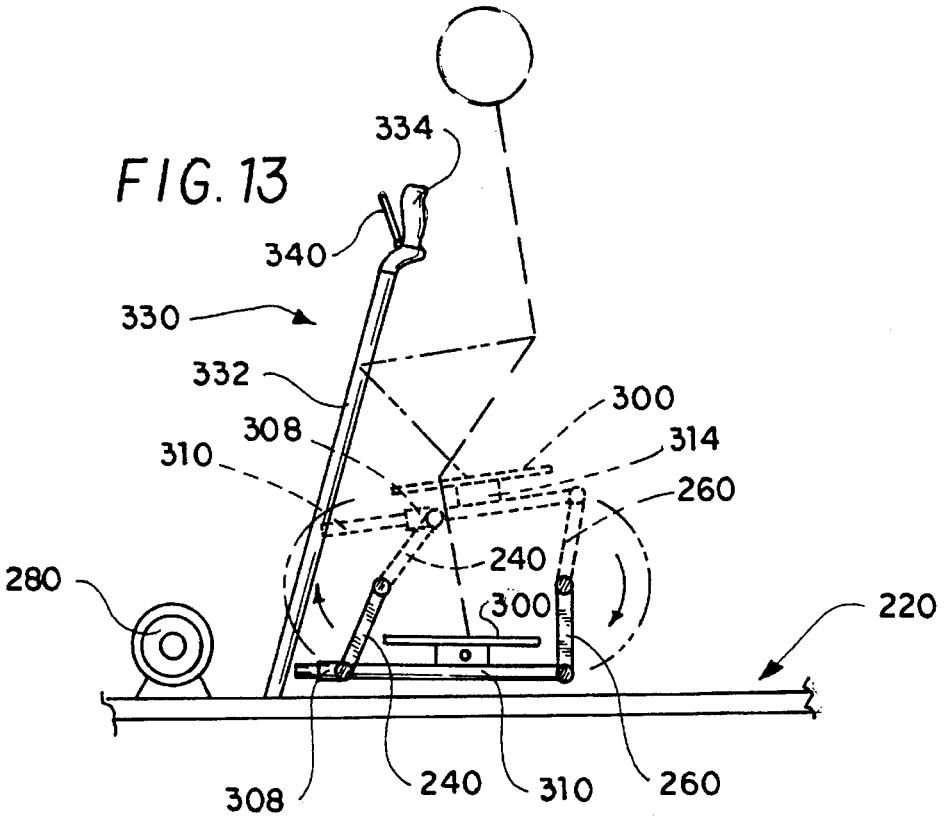
FIG. 13 is a diagrammatic representation of the operation of the exercise apparatus shown largely in elevation.
Figure 14:
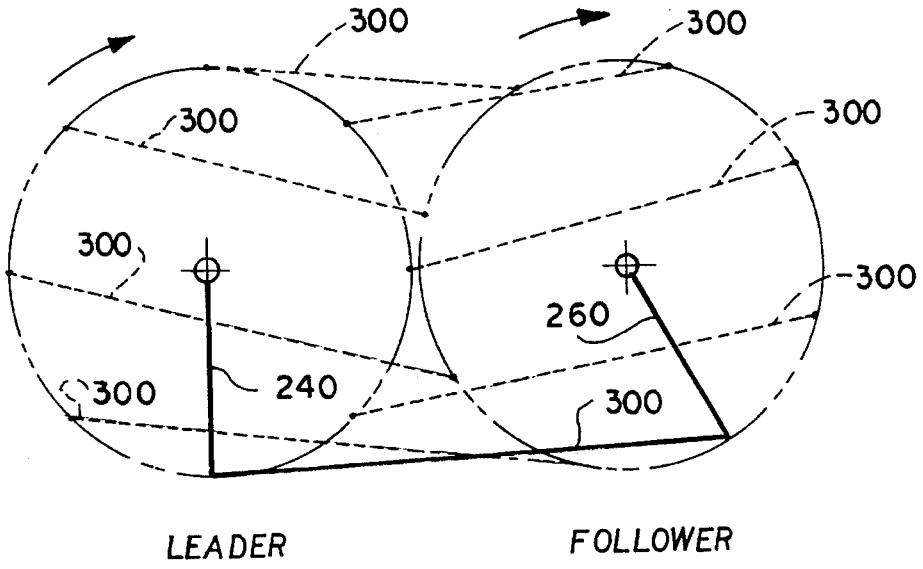
FIG. 14 is a diagrammatic representation of the rotational displacement of the platform.

In operation, as shown in FIGS. 13 and 14, the prime mover 280 drives the arbor 292 which, in turn, transmits power to the first or lead crank assembly 240 and further, to the second or follower crank assembly 260. The crank assemblies 240, 260 are timed such that the first crank assembly 240 proceeds the second crank assembly 260, such as by 25 degrees. This enables the platform 300 to incline on an upward stroke and to decline on a downward stroke. That is to say, the forward end raises up on the upward stroke and tilts down on the downward stroke, simulating mogul skiing conditions.

Referring back to FIG. 10, the alternative exercise apparatus 210 may further include amenities, such as bindings and poles. The bindings, such as the bindings 108 described above, may be supported atop the platform 300. The poles 330 may be comprised of standards 332 and handgrips 334, such as the standards 120 and a handgrips 124 described above. The standards preferably extend upwardly and rearwardly from the front of the base 220.

It should be noted that a switch element 340, such as a normally opened deadman switch, may be located in the proximity of at least one of the handgrips 334, as is shown in FIG. 13. Upon grasping the handgrip 334, the deadman 340 is clinched by the user, closing the switch 340 and, in turn, completing a circuit (not shown), thus permitting current to flow through the prime mover 280. This current actuates the prime mover 280 which, in turn, drives the crank assemblies 240, 260 via the power transmitting element 290. If the user were to inadvertently loose his or her grasp of the handgrip 334, the switch 340 would open and the prime mover 280 would cease to drive the crank assemblies 240, 260.

Alternatively, a light curtain beam (not shown) may interrupt current flow to the prime mover 280. Light curtain beams may disposed about the platform 300, outside of the range of the rotation of the crank assemblies 240, 260. In event that the user breaks the transmission of these beams, current to the prime mover 280 would be interrupted and the exercise apparatus 210 would cease to operate.

Unlike the first embodiment 10 described above, the operation of the alterative exercise apparatus 210 is dependent on the prime mover 280. The prime mover 280 supplies the energy and the leg muscles of a user absorb the energy supplied by the prime mover 280. This more accurately simulates mogul skiing conditions.

The first embodiment 10 does not include prime mover, all of the energy required to operate the exercise apparatus 10 is supplied by the user. The legs supply energy to operate the exercise apparatus 10 over approximately 70 percent of the rotation of the crank assembly 40. On the upward stroke, an upward force is delivered by the exercise apparatus 10.

It is to be understood that the present invention is not limited to the embodiments described above, but encompasses any and all embodiments within the scope of the following claims.

We claim:

1. An exercise apparatus for simulating alpine mogul skiing comprising:

a base;

a first crank assembly supported by said base, said first crank assembly being rotatable through a complete circle about a first axis of rotation;

a second crank assembly supported by said base, said second crank assembly being rotatable through a complete circle about a second axis of rotation, said first axis of rotation being parallel to said second axis of rotation;

a platform support slidably and pivotally attached to said first crank assembly and pivotally attached to said second crank assembly;

a primer mover supported by said base; and a power transmitting element connecting said prime mover to said first and second crank assemblies.

2. An exercise apparatus according to claim 1, wherein said base includes stabilizers.

3. An exercise apparatus according to claim 1, further comprising:

a platform attached to said platform support.

4. An exercise apparatus according to claim 3, wherein said platform support includes a universal joint assembly for pivotally supporting said platform.

5. An exercise apparatus according to claim 3, further including bindings supported by said platform.

6. An exercise apparatus according to claim 1, further comprising:

two platforms attached to said platform support.

7. An exercise apparatus according to claim 6, wherein said platform support includes a universal joint assembly for pivotally supporting each one of said platforms.

8. An exercise apparatus according to claim 6, further including bindings supported by each one of said platforms.

9. An exercise apparatus according to claim 1, further including a pair of spaced posts, each one of said posts comprising a standard extending from said base.

10. An exercise apparatus according to claim 9, further including handgrips affixed to each one of said posts.

11. An exercise apparatus according to claim 10, further including a switch element disposed proximate one of said handgrips, said switch element being arranged and configured to interrupt operation of said prime mover.

12. An exercise apparatus according to claim 11, wherein said switch is a normally opened deadman switch.

13. An exercise apparatus according to claim 1, further including a switch element comprising a light curtain beam arranged about said crank assemblies and outside a range of rotation of said crank assemblies.

14. An exercise apparatus according to claim 1, wherein said prime mover is an electrical motor.

15. An exercise apparatus according to claim 14, further including a switch element arranged and configured to interrupt operation of said electrical motor.

16. An exercise apparatus according to claim 15, wherein said switch element is a light curtain beam arranged about said crank assemblies and outside a range of rotation of said crank assemblies.

17. An exercise apparatus according to claim 14, further including a variable speed controller arranged in connection with said electrical motor.

18. An exercise apparatus comprising:

a base;

a first crank assembly supported by said base, said first crank assembly being rotatable about a first axis of rotation;

a second crank assembly supported by said base, said second crank assembly being rotatable about a second axis of rotation, said first axis of rotation being parallel to said second axis of rotation:

a prime mover supported by said base; and a power transmitting element including, a first series of sprockets and belts connecting said prime mover to said first crank assembly; and a second series of sprockets and belts connecting said first crank assembly to said second crank assembly.

19. An exercise apparatus comprising:

a base;

a first crank assembly supported by said base, said first crank assembly being rotatable about a first axis of rotation;

a second crank assembly supported by said base, said second crank assembly being rotatable about a second axis of rotation, said first axis of rotation being parallel to said second axis of rotation:

a prime mover supported by said base, said prime mover including a drive sprocket; and a power transmitting element including, an arbor having an arbor input sprocket and an arbor output sprocket, a first crank assembly input sprocket and a first crank assembly output sprocket carried by said first crank assembly, and a second crank assembly input sprocket carried by said second crank assembly; and a first cog belt connecting said drive sprocket to said arbor input sprocket, said arbor output sprocket to said first crank assembly input sprocket, said first crank assembly output sprocket to said second crank assembly input sprocket.

* * * * *